US008395328B2

(12) United States Patent
Quick et al.

(10) Patent No.: US 8,395,328 B2
(45) Date of Patent: Mar. 12, 2013

(54) LIGHT EMITTING DIODE DRIVER AND METHOD

(75) Inventors: Ashleigh Glen Quick, Bowden (AU); Andrew Newman, Bowden (AU)

(73) Assignee: Clipsal Australia PTY Ltd, Baulkham Hills (AU)

( * ) Notice: Subject to any disclaimer, the term of this patent is extended or adjusted under 35 U.S.C. 154(b) by 446 days.

(21) Appl. No.: 12/447,945

(22) PCT Filed: Nov. 5, 2007

(86) PCT No.: PCT/AU2007/001697

§ 371 (c)(1), (2), (4) Date: Dec. 15, 2009

(87) PCT Pub. No.: WO2008/052293

PCT Pub. Date: May 8, 2008

(65) Prior Publication Data

US 2010/0102734 A1 Apr. 29, 2010

(30) Foreign Application Priority Data

Nov. 3, 2006 (AU) ..... 2006906139

(51) Int. Cl.
*G05F 1/00* (2006.01)
*H05B 37/00* (2006.01)

(52) U.S. Cl. ..... 315/291; 315/312

(58) Field of Classification Search ..... 315/291, 315/292, 293, 294, 295, 307, 308, 309, 311, 315/312, 314, 315, 316, 318, 321, 323, 324, 315/325, 185 R
See application file for complete search history.

(56) References Cited

U.S. PATENT DOCUMENTS

| | | | | |
|---|---|---|---|---|
| 6,211,626 | B1 * | 4/2001 | Lys et al. | 315/291 |
| 6,777,891 | B2 * | 8/2004 | Lys et al. | 315/291 |
| 7,253,566 | B2 * | 8/2007 | Lys et al. | 315/291 |
| 7,394,210 | B2 * | 7/2008 | Ashdown | 315/291 |
| 7,557,521 | B2 * | 7/2009 | Lys | 315/294 |
| 7,710,369 | B2 * | 5/2010 | Dowling | 345/83 |
| 7,845,823 | B2 * | 12/2010 | Mueller et al. | 362/231 |
| 2003/0057887 | A1 | 3/2003 | Dowling et al. | |
| 2004/0257007 | A1 | 12/2004 | Lys et al. | |

* cited by examiner

*Primary Examiner* — Minh D A
(74) *Attorney, Agent, or Firm* — Greenblum & Bernstein, P.L.C.

(57) ABSTRACT

Disclosed is a method and apparatus for controlling a plurality of Light Emitting Diodes (LEDs). A communications protocol is also provided, which comprises a START code, a first Command packet and at least one subsequent Command packet. An LED driver receives a signal according to the protocol, and separates the first Command packet from the signal and controls an LED associated with the LED driver in accordance with instructions in the first Command packet. The LED driver then outputs the remaining signal for use by one or more subsequent LED drivers.

14 Claims, 9 Drawing Sheets

LIGHT EMITTING DIODE DRIVER AND METHOD

TECHNICAL FIELD

This invention relates to Light Emitting Diodes and to apparatus and methods for their control.

PRIORITY

The present application claims priority from Australian Provisional Patent Application No. 2006906139 entitled "Light Emitting Diode Driver and Method".

The entire content of this provisional application is hereby incorporated by reference.

BACKGROUND

A common requirement for electronic equipment is to have a visual indication on a control device. Such a control device could be a button, lever, knob, or similar, and the visual indication is often used to show the state of whatever is controlled—for example an electrical load being turned on or off, or a door open or closed.

In modern electronic equipment, the visual indication is readily provided by a light emitting diode (LED) which has the advantages of being small, cheap, and a long operating life. Multiple colours may be achieved by making use of several LEDs of different colour—these can even be mounted in the same physical package.

By separate dimming of each component colour, a dual-colour combination LED can be used to mix the two component colours to create additional colours, as perceived by a human observer. More recently, three colour combination LEDs have become available, and some of these include elemental components that emit in the colours Red, Green and Blue. By selective dimming of these components, any colour, including white, can be obtained.

In order to produce any resultant colour, an RGB combination LED needs each of the colour components to have a separate dimmable drive. Whilst LED dimming is straightforward using the well-established method of pulse-width modulation, such a typical combination LED will usually have at least 4 terminals: a common point and a drive input for each of the three colour elements.

Using a single three colour RGB combination LED with a common point and 3 drive inputs is relatively easy to drive to obtain any desired human-perceived colour. For example, a small micro-processor can use 3 separate pulse-width modulated outputs to drive such an indicator. An exemplary arrangement of this application is shown in prior art FIG. 1. In FIG. 1, there is shown microprocessor 10 driving two LEDs 30 and 30'. Each LED has respective colour components of red (31), green (32) and blue (33). Respective resistors 34, 35 and 36 are also provided to limit the current applied to the LED components.

In operation, microprocessor 10 generates and transmits control signals to each LED 30 and corresponding colour component 31, 32 and 33 to control the operation of each LED in accordance with a sequence of instructions programmed into microprocessor 10 as will be understood by the person skilled in the art.

As can be seen from FIG. 1, driving 2 LEDs requires 6 drive signals 11, 12, 13, 14,15 and 16, one for each LED component, or three for each LED in the case of a three-colour LED.

It will be appreciated however, that when many such combination LEDs need to be driven (irrespective of the number and nature of the coloured elements)—potentially all showing separate information (for example colour and brightness) the number of drive signals rapidly increases. For example to drive 10 such RGB combination LEDs would require 30 drive signals. As the number of multi-colour combination LEDs in a product increases, the complexity of wiring these to a controller device increases, as does the complexity of the controlling device. For example, a large number of wiring paths might be needed on a printed circuit board, and a large number of pulse width modulated outputs might be needed on a microprocessor.

LED controller devices are currently available that make use of serial data buses—the most notable being the Philips inter-integrated circuit (I2C) bus. Such LED controllers allow a 2-wire control output from a microprocessor to be connected to a LED driver IC, which in turn is connected to one or more combination LEDs. By sending appropriate commands to the I2C driver IC, a suitable colour and brightness can be obtained from the combination LED(s). If the combination LED contains red, green and blue elements, then by appropriate selection of brightness of the elements, any colour can be obtained.

Whilst being an improvement on directly connecting LEDs to a microprocessor, systems using these approaches have a number of deficiencies. These deficiencies include the high cost of the LED driver ICs, the limited addressing range of these bus systems, and the additional need to route power and/or ground separately to the LEDs and the driver IC's—increasing circuit board layout complexity and potentially cost, through the need for multi-layer PCBs. Whilst this limited addressing can be overcome by the use of I2C bridges, this adds extra devices and cost to such an arrangement.

It is therefore an object of the present invention to provide an alternative to existing LED control systems.

SUMMARY OF THE INVENTION

According to a first aspect of the present invention, there is provided a communications protocol for use in controlling a plurality of Light Emitting Diodes (LEDs) associated with respective LED drivers, the communications protocol comprising a first Command packet containing at least one instruction for controlling a first of the plurality of LEDs, and at least one subsequent Command packet containing instructions for controlling at least one subsequent LED, connected in series with the first LED.

In one form, the protocol further comprises a START code prior to the first Command packet.

In one form, the respective START codes are provided prior to each subsequent Command packets.

In one form, at least one of the first and subsequent Command packets contains instructions for controlling a plurality of elements within a respective LED.

According to a second aspect of the present invention, there is provided a Light Emitting Diode (LED) driver comprising:

- an input for receiving a signal according to the communications protocol as claimed in any one of claims 1 to 4;
- means for controlling an associated LED in accordance with the at least one instruction in the first Command packet; and
- an output for outputting the at least one subsequent Command packet.

In one form, the LED further comprises means for separating the first Command packet from the signal.

According to a third aspect of the present invention, there is provided a Light Emitting Diode (LED) comprising an LED driver according to the second form of the present invention.

According to a fourth aspect of the present invention, there is provided a device for controlling a plurality of LEDs, the device comprising:

means for generating and outputting a signal comprising a START code, a first Command packet and at least one subsequent Command packet;

first means for receiving the signal and controlling an LED associated with the first means in accordance with instructions in the first Command packet;

first means for separating the first Command packet from the signal to provide a remaining signal; and means for outputting the remaining signal.

In one form, the means for generating is a microprocessor.

In one form, the first means for receiving and controlling, the first means for separating and the means for outputting comprise an LED driver.

In one form, the LED driver is a microprocessor.

In one form, there is at least one subsequent driver associated with at least one subsequent LED.

According to a fifth aspect of the present invention, there is provided an electronic device comprising:

a plurality of Light Emitting Diodes (LEDs);

a plurality of LED drivers as claimed in claim 5 for controlling a respective one of the plurality of Light Emitting Diodes; and a microprocessor for generating and outputting a signal according to the communications protocol as claimed in any one of claims 1 to 4 to a first of the plurality of LED drivers.

According to a sixth aspect of the present invention, there is provided a method for controlling a plurality of LEDs, the method comprising:

generating and outputting a signal comprising a START code, a first Command packet and at least one subsequent Command packet;

receiving the signal and controlling an LED in accordance with instructions in the first Command packet;

separating the first Command packet from the signal to provide a remaining signal; and outputting the remaining signal.

According to a seventh aspect of the present invention, there is provided a machine readable medium containing machine executable instructions to perform the method of the sixth aspect of the present invention.

DETAILED DESCRIPTION

Figure 1:
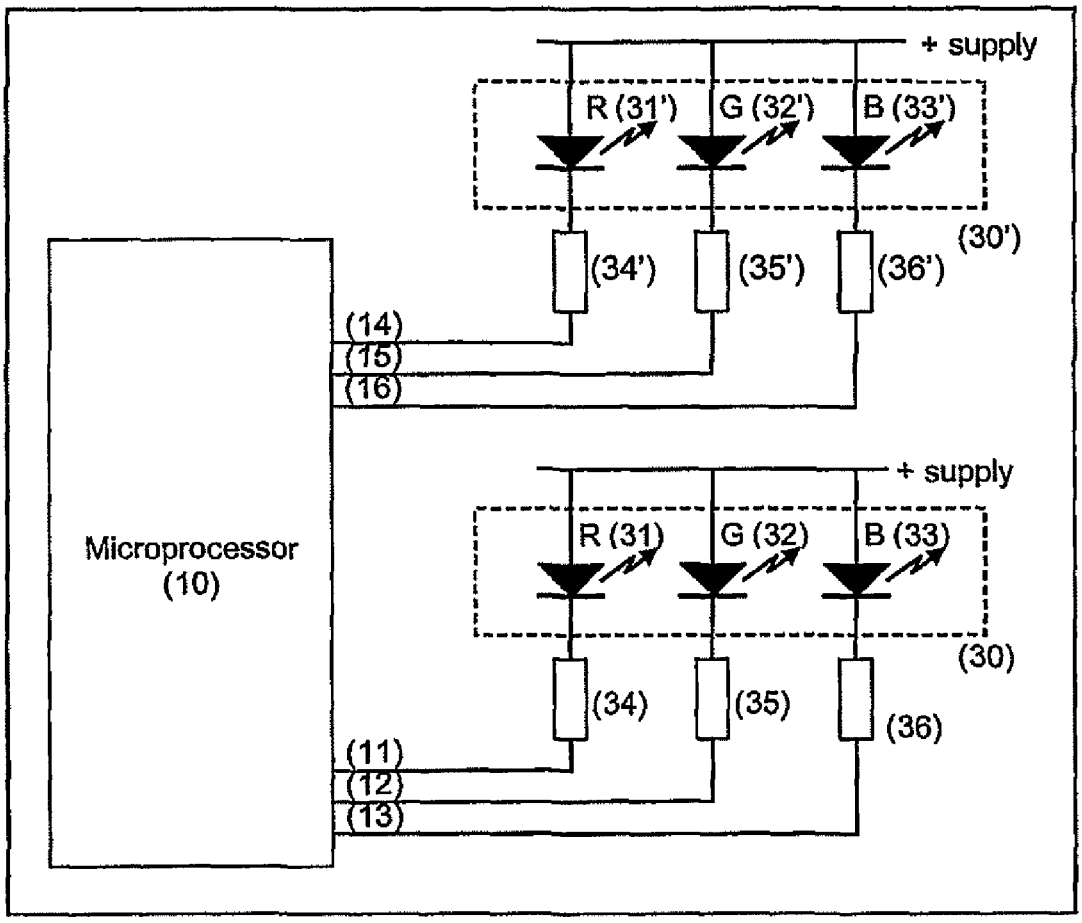
Figure 1 Prior Art
FIG. 1—shows a prior art arrangement with 2 RGB combination LEDs connected to a microcontroller.
Figure 2:
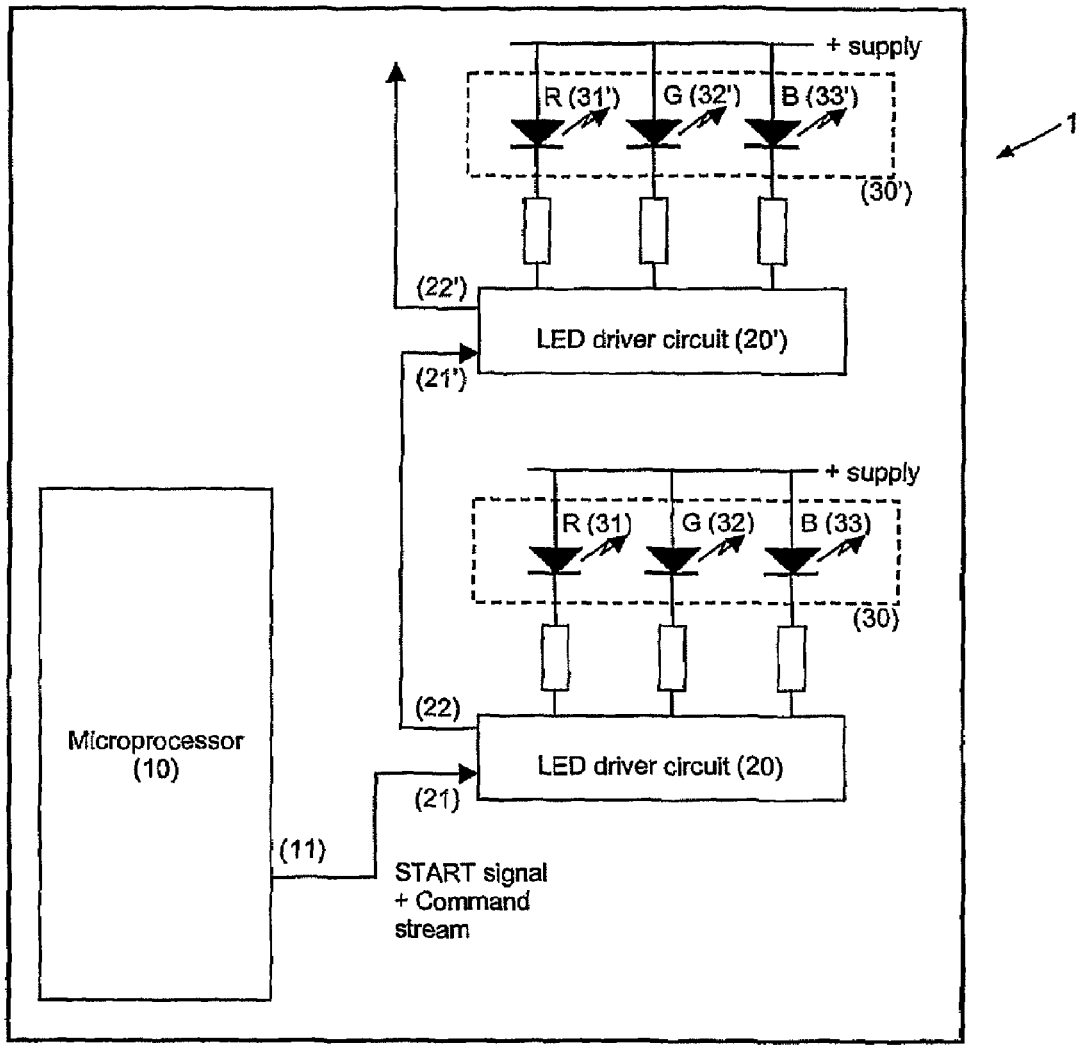
FIG. 2—shows a first exemplary implementation of an aspect of the present invention in which several LED driver circuits are connected to a single microprocessor output.

FIG. 2 shows an electronic device 1 showing an exemplary arrangement of components according to a first aspect of the present invention. In FIG. 2 there is shown a microprocessor 10 with a single output signal 11 connected to LED driver circuit constructed according to another aspect of the present invention. Details of the operation of LED driver circuit 20 will be discussed in more detail further below. LED driver 20 drives LED 30.

FIG. 2 also shows a second LED 30', driven by a second LED driver 20'.

Microprocessor 10 can be any microprocessor, from any manufacturer, that is capable of transmitting a data stream out of a single output—a technique commonly referred to as "bit bashing". Such microprocessors are readily available from many manufacturers, in an almost infinite variant of capability variations. Suitable microprocessors are available from manufacturers including Atmel, Texas Instruments, Zilog, Freescale, ST, and many others.

According to an aspect of the present invention, microprocessor 10 generates a control signal and transmits this along output 11 to an input 21 of the LED driver 20.

As will be described in more detail further below, the signal generated by microprocessor 10 consists of a series of Command packets, each intended for one of the LEDs needed to be controlled by microcontroller 10. Driver 20 accepts the signal, and strips off (or separates) the first Command packet in the signal or data stream, and outputs the remainder of the signal or data stream via output 22. The remainder of the signal is then input into the input 21' of the next LED driver 20', which then strips off the next Command packet and outputs the remainder of the signal via output 22'. The signal continues to travel from one LED driver to the next, until all Command packets have been stripped off or separated.

The Command packet for each LED contains information to allow each LED driver 20 to drive each of the red (31), green (32) and blue (33) light components of respective LEDs.

In one form, the communication protocol includes a START code indication, followed by one or more subsequent Command packets. The first Command packet is applied to the first LED driver circuit that the signals reach after the controlling device, and is removed from the stream. Everything after the first Command packet is then passed out of the first LED driver circuit to the second LED driver circuit and so on, as described above. Each LED driver circuit knows to expect a new Command packet when it sees the START code.

Figure 3:
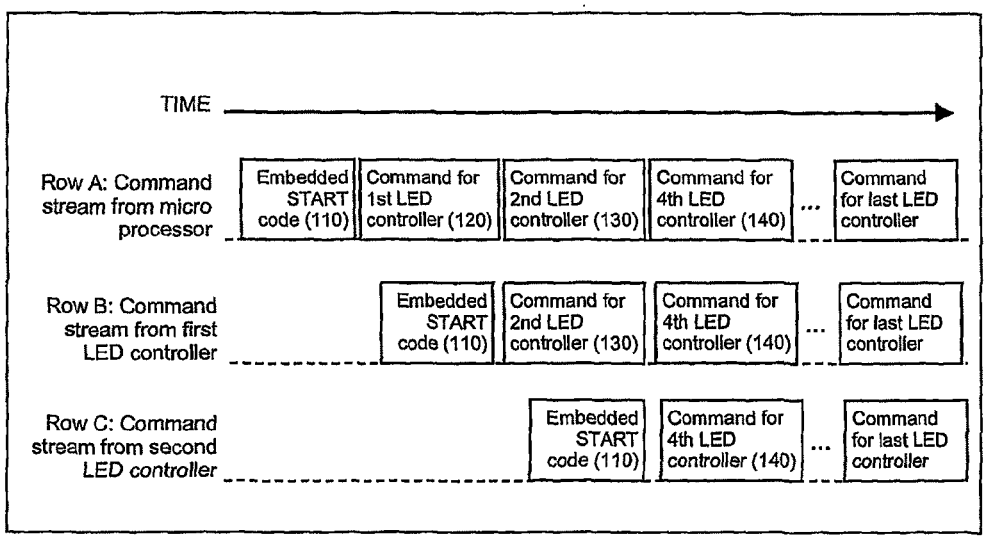
FIG. 3—shows an exemplary timing diagram and command sequence that could be applied to the arrangement of FIG. 2.
Figure 4:
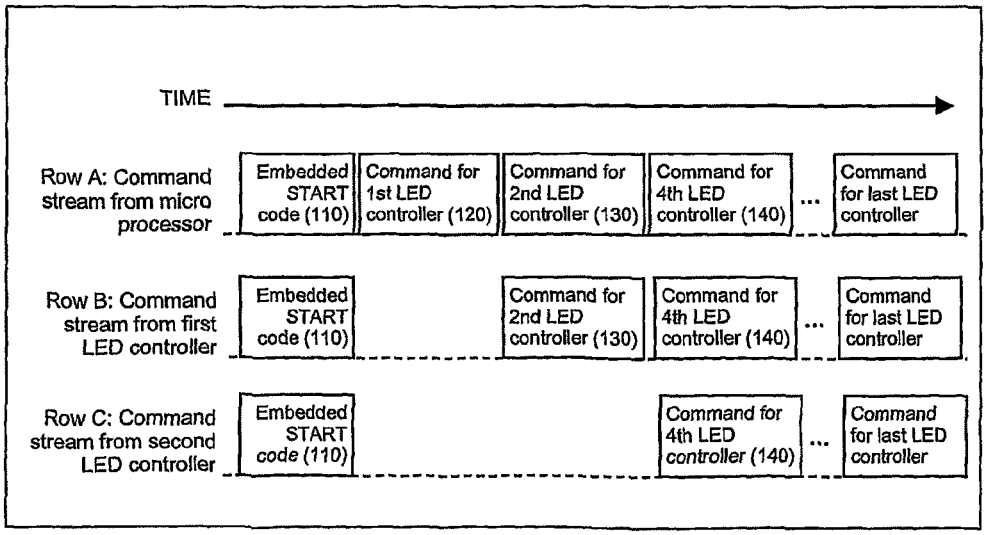
FIG. 4—shows an alternative exemplary timing diagram and command sequence that could be applied to the arrangement of FIG. 2.

To ensure that the START code is passed along, each LED driver circuit can either re-generate the START code, as shown in FIG. 3, or can simply pass it out when it is received, as shown in FIG. 4.

In one form, the LED driver circuit 20 has the function of accepting in its Command packet a setting of the brightness of each of the colour elements of its attached combination LED.

By placing the LED driver circuits in a sequential cascade arrangement, there is no need to address information to each circuit—instead, addressing will be achieved by the order of the electrical interconnection. Thus, for example, the first Command packet will be accepted by the first LED driver circuit (and subsequent Command packets are simply passed out to the next one in the line). Similarly the second LED driver circuit, not seeing the Command packet that was removed by the first LED driver circuit, will accept the second Command packet transmitted, and pass on any that follow. This process is repeated until the last LED driver circuit is reached.

FIGS. 3 and 4 show an exemplary structure of such a signal, containing multiple Command packets. FIG. 3 shows the case where the START code is regenerated, while FIG. 4 shows the case where the START code is copied instead of being regenerated. The first row (A) of FIGS. 3 and 4 show the signal as generated by the microprocessor 10. This signal is input to the input 21 of the first LED driver device 20 (for example as seen in FIG. 2). In one form, the signal may include a START code 110 at the beginning of the signal. In one form, the START code 110 comprises a pattern that is distinguishable from the Command packet information. When a LED driver circuit recognises the sequence comprising the START code, it knows that the Command packet that follows is for its use, and subsequent commands are to be relayed out to a subsequent device.

One suitable method of generating the START code is to encode the Command portions using "bit-stuffing", and use a coding violation as the START code—a technique which is well established in the prior art. Another possible method is to transmit the Command portion as a stream of asynchronous serial data bits, and to transmit a "Break" symbol as the START code. Whilst these are two suitable methods, there are many others that provide the same behaviour.

Following the START code 110, when present, is the first Command 120. This Command contains control information for the first LED driver 20 to control the various elements of the LED 30 to which it is connected (see FIG. 2). Upon receiving the signal, LED driver 20 strips off, or otherwise "switches off" the first Command so as to be not present, or ignored by subsequent LED drivers, and retransmits or otherwise forwards the signal from its output 22 to the next LED driver 20' in the series.

The signal may contain as many Commands as there are LED drivers, or may contain more or less, depending upon the required function of the LEDs to be controlled. For example, if there are more Commands than LEDs, the extra Commands could be simply ignored. If there are fewer Commands than LEDs, either the extra LEDs may not be provided instructions, or the extra LEDs may perform the same function as the last LED which had a specific Command, or could be otherwise connected to previous LEDs to perform the same function as those.

In line B of FIGS. 3 and 4, the signal can be seen to have had the first Command 120 removed, with subsequent Commands 130 and 140 remaining. This is the structure of the signal on the output 22 of LED driver 20 and the input 21' of LED driver 20' in FIG. 2. In row C, the signal can be seen to have had first and second Commands removed, to have remaining the last Command for the last LED required to be controlled. In the case of FIG. 2, this signal structure will appear on the output 22' of LED driver 20', for input into the next LED driver (not shown).

The structure of each Command will be tailored for the required operation of each individual LED 30. In one example, the structure of the Command can be a set of binary coded brightness levels for each individual LED. For RGB LEDs, the Command might comprise typically between 4 and 8 bits to encode the brightness levels of the Red, Green, and Blue component LEDs. Any precise ordering or encoding of these brightness levels is unimportant, provided it is applied consistently between the microprocessor 10 and all LED driver circuits.

In this manner, a single microprocessor could drive a single combination LED, or any other number, without additional hardware interconnections being required to the microprocessor. In another form, this arrangement could be used to drive two or more LEDs having only one colour component, or having any number of colour components. In some forms, the LEDs driven could have varying numbers of colour or other control components, for example, the microprocessor might set a flash pattern on a LED, or combination LED, by setting a flash rate, or setting periods of time for a LED or LED components are to be switched on and off.

For example, a system may have 10 LEDs, 5 of which may be single colour components, 2 may be 2-colour components and 3 may be 3-colour components. Of course the number of controllable components within an LED need not be restricted to 3, but could be any number as may be required for the particular application.

One example of a structure of a Start bit used as the Start code, is 1440 us wide, with a low for 960 us and a high pulse for 480 us. A data bit definition for the Command packets could be "Bit 0" having 60 us width with a 20 us low and a 40 us high pulse. The "Bit 1" definition could have a 60 us width with 40 us low and 20 us high pulse. Such coding is known as Manchester coding and is well known to the person skilled in the art. Of course, any other form of suitable coding may also be used.

In generating a signal according to this aspect of the invention, the microprocessor does so in accordance with a software program. An example of a suitable program for controlling five LEDs, 2 of a single colour component and 3 of 3 colour components is shown in the following pseudo-code:

Assumptions:

- A single Command comprises brightness for Red, Green and Blue, in that order
- A single colour LED has its brightness set by the Red component of a Command only
- A suitable coding system has been chosen for the Commands and the START code
- The two single colour LEDs are wired closest to the microprocessor, followed by the 3, 3 colour LEDs Pseudo-code:

- Send the START code
- Send the Command for the first single colour LED comprising the set (First brightness, anything, anything)
- Send the Command for the second single colour LED comprising the set (Second brightness, anything, anything)
- Send the Command for the third LED comprising the set (Third Red, third Green, Third Blue)
- Send the Command for the fourth LED comprising the set (Fourth Red, Fourth Green, Fourth Blue)
- Send the Command for the fifth LED comprising the set (Fifth Red, Fifth Green, Fifth Blue)

In an alternative form of the present invention, the signal generated by the microprocessor 10 need not have a START code embedded therein. In this case, two microprocessor outputs may be used, the first such output being used to signal the start of a new command stream, and the second such output being used to encode the stream of Commands being sent to each of the driver circuits in turn. Such an encoding of the Commands could comprise digital data, typically as a stream of binary digits (bits).

Figure 5:
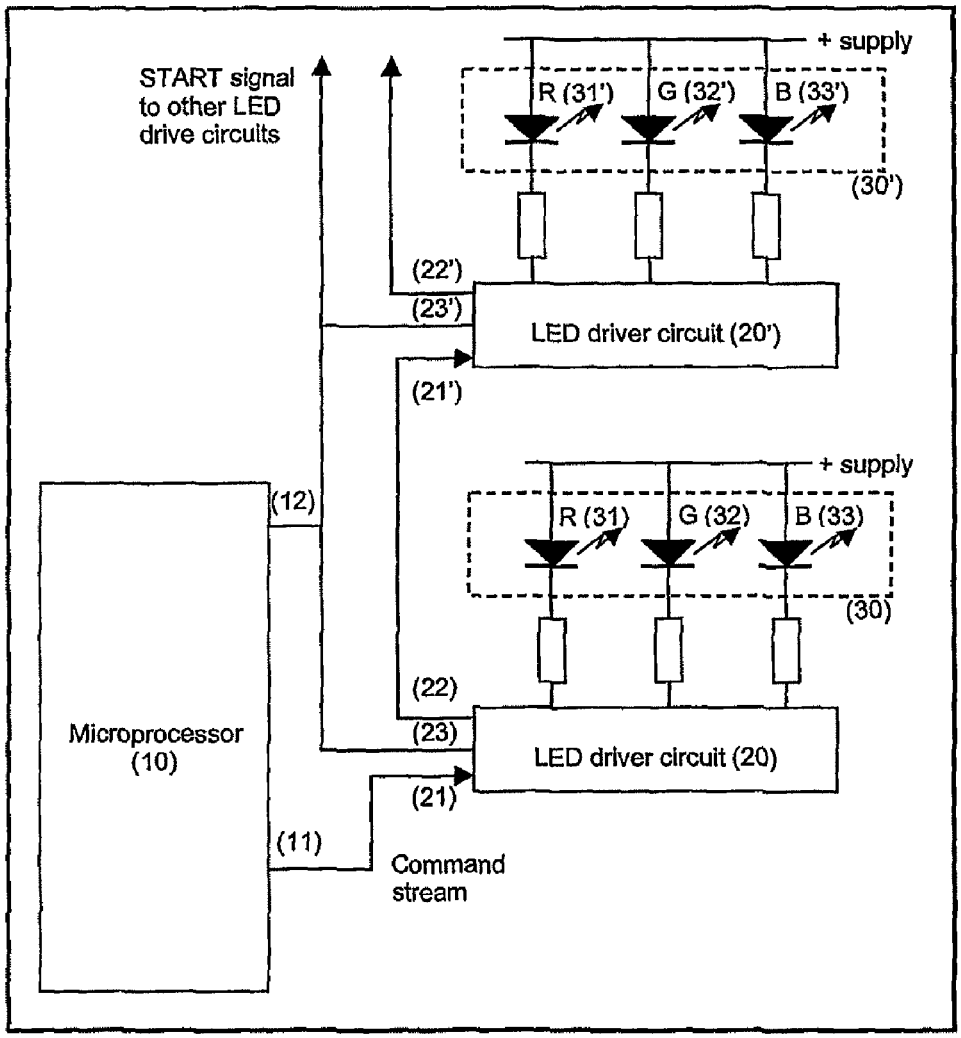
FIG. 5—shows a second exemplary implementation according to an aspect of the present invention, in which two LED driver circuits are connected to 2 microprocessor outputs.

FIG. 5 shows an arrangement according to this aspect of the invention, in which like elements are numbered accordingly. In this arrangement, microprocessor 10 has two outputs, 11 and 12. Output 11 functions as previously described with reference to FIG. 2, but output 12 now provides the START information to inform each LED driver 20, 20' . . . when a new Command stream is being transmitted, in place of the START code being present in the signal.

In this arrangement, LED drivers 20, 20' . . . will have a third input 23, for receiving the START code from microprocessor 10.

Figure 6:
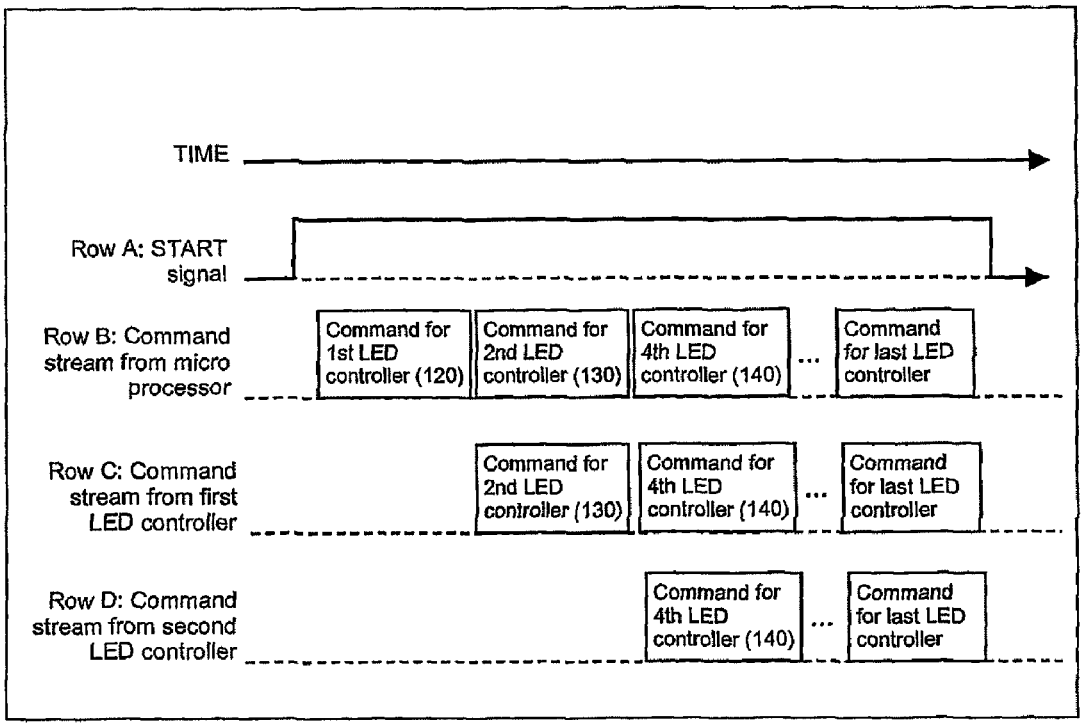
FIG. 6—shows an exemplary timing diagram and command sequence that could be applied to the arrangement of FIG. 5.

FIG. 6 shows an exemplary structure of the control signals generated by microprocessor 10 in the arrangement as shown in FIG. 5. In row A of FIG. 6, a START code is provided on output 12 of microprocessor 10 and input to each of the LED drivers 20 via respective inputs 23. Row B shows the structure of the signal generated by microprocessor 10 and output on output 11, to be received by each LED driver 20 in turn. It will be noted that no START code is present in this structure as it is being provided by output 12. Rows B, C and D of FIG. 6 correspond to rows A, B and C of FIGS. 3 and 4 and function in the same way.

Figure 7:
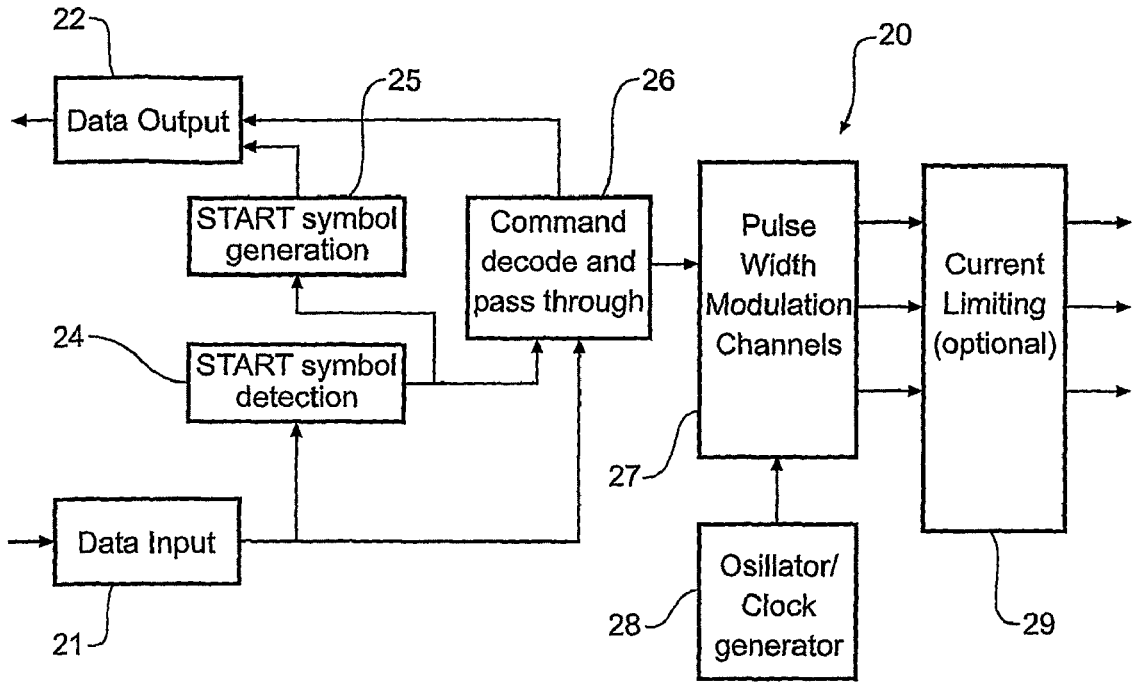
FIG. 7—shows a block diagram of an LED driver as shown in FIG. 2.

FIG. 7 shows an exemplary system block diagram of an LED driver circuit for an LED driver as shown in FIG. 2 that has a single input for receiving a START code and Command packets. In this arrangement, the START code and Command packets enter driver 20 at data input 21. The START code is detected at block 24 and the Command packet is received at block 26, decoded and passed to pulse width modulation (PWM) channels block 27 for application to the components of the LED (not shown) via an optional current limiting block 29. Oscillator/clock generator 28 provides the timing for block PWM block 27.

From block 26, the remaining Command packets are passed through to data output 22. If the START code is to be regenerated and passed through to subsequent drivers, this is done at block 35 and provided to output 22 with the remaining Command codes from block 26.

Figure 8:
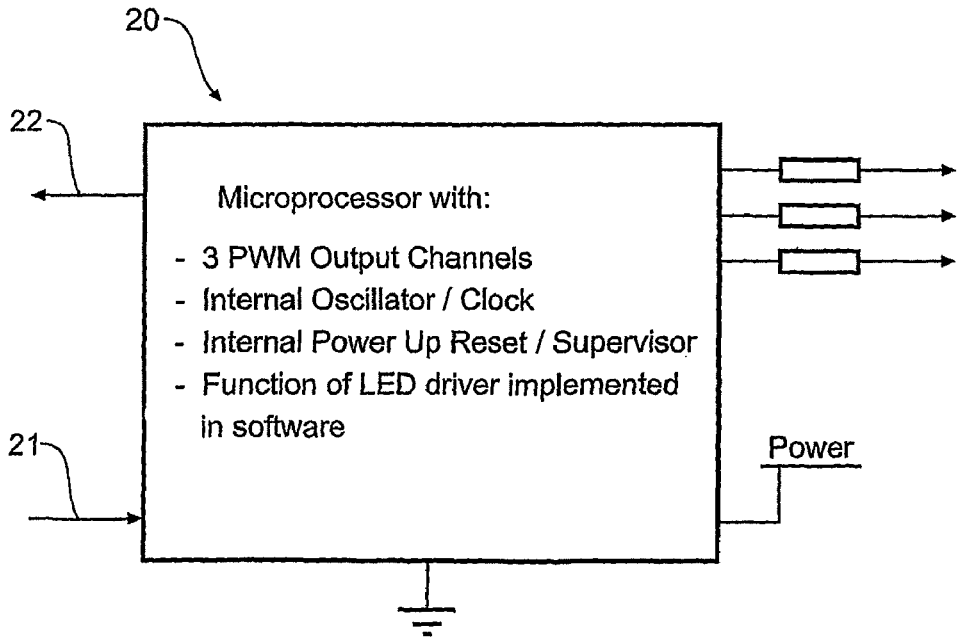
FIG. 8—shows a reference circuit diagram of the LED driver of FIG. 2.

FIG. 8 shows a reference circuit diagram of the arrangement of FIG. 7. This reference circuit uses a small, low-cost microprocessor as the main element of the LED driver circuit, with all major functions implemented in software. Suitable microprocessors are available from Texas Instruments, Freescale, and other manufacturers. Naturally, such an arrangement can be replaced by any other functionally equivalent circuit, whether using software or not.

Figure 9:
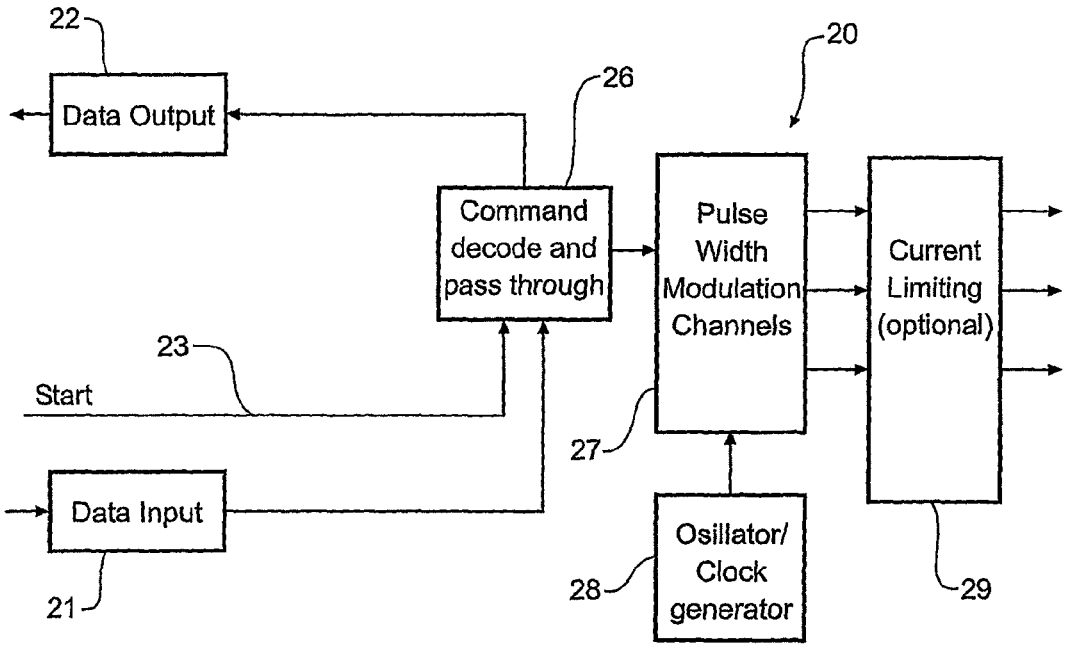
FIG. 9—shows a block diagram of an LED driver as shown in FIG. 5.

FIG. 9 shows an exemplary system block diagram of an LED driver circuit for an LED driver as shown in FIG. 5 that has a single input for receiving a START code and Command packets. This is an alternative arrangement for driver 20 to that of FIG. 7. In this arrangement, the Command packets enter driver 20 at data input 21. The START code that is generated separately at a second output of microprocessor 10 (as described previously with reference to FIG. 5) enters driver 20 at second input 23. The Command packets and START code are received at block 26. The Command packets are decoded and passed to pulse width modulation (PWM) channels block 27 for application to the components of the LED (not shown) via an optional current limiting block 29. Oscillator/clock generator 28 provides the timing for block PWM block 27.

The START code and remaining Command packets are then sent to subsequent drivers via output 22.

The arrangement of FIG. 9 can equally be implemented as a single microprocessor having programmed thereon instructions to carry out the functions of the arrangement of FIG. 9. This would be as shown in FIG. 8.

Figure 10:
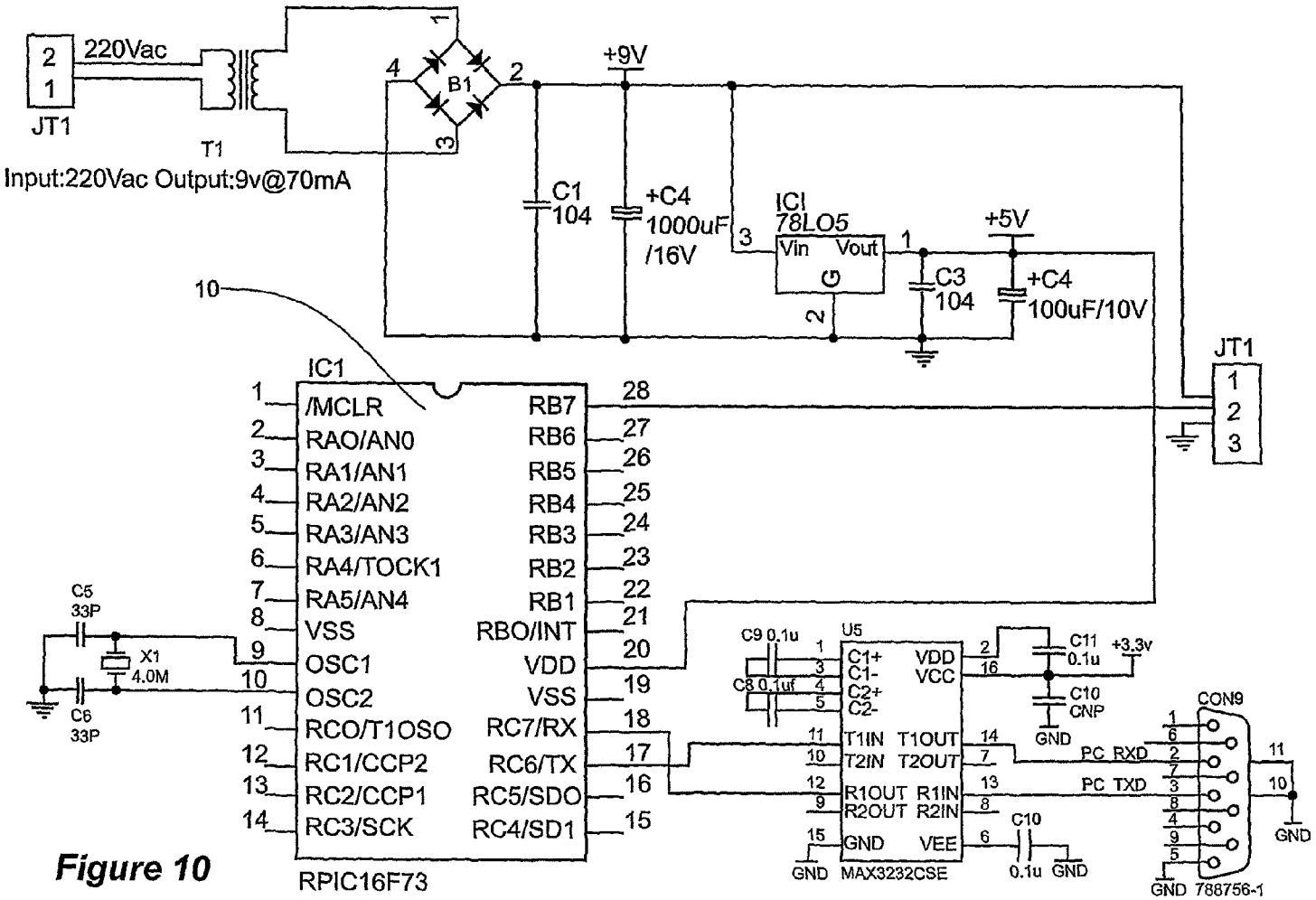
FIG. 10—shows a circuit diagram of an exemplary embodiment of the master section of the arrangement shown in FIG. 2.

FIG. 10 shows an alternative embodiment of the LED controller master section, showing microprocessor 10, which in this example is a PIC16F73. The particular layout and function of the surrounding circuitry will be apparent to the person skilled in the art and will not be described in detail herein.

Figure 11:
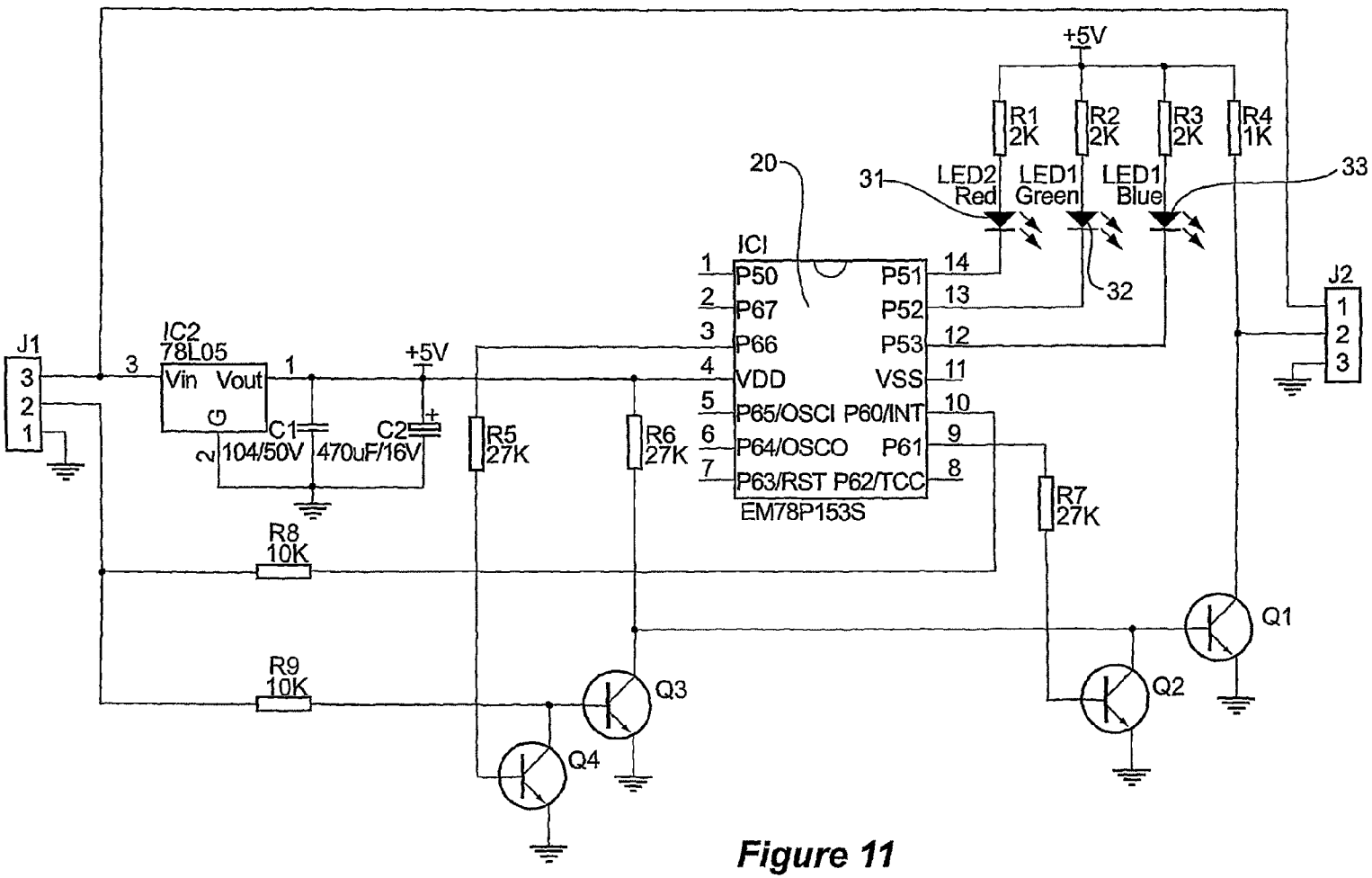
FIG. 11—shows a circuit diagram of an exemplary embodiment of the driver section of the arrangement shown in FIG. 2.

FIG. 11 shows an implementation of an LED driver 20 and associated LED 30 with individually-drivable colour components 31 (Red), 32 (Green) and 33 (Blue). In this example, the microprocessor used for the driver 20 is an EM78P153S available from ELAN Microelectronics Corporation in Taiwan. Again, the layout and function of the surrounding circuitry will be apparent to the person skilled in the art and will not be described in detail herein.

In use, a circuit will be built up using a plurality of drivers 20 as shown in FIG. 11, cascaded in daisy-chain style. Each LED 30, 30', 30" e.t.c. would be associated with its own driver 20, 20', 20" e.t.c.

In another aspect of the invention, there is provided a method of controlling a plurality of LEDs. The first aspect of the method provides for the generation of a signal or data stream according to the protocol described above. In particular, the method includes generating the signal or data stream by generating a Start code, generating a first Command packet, generating at least one subsequent Command packet and then outputting the signal. A further aspect of the method includes receiving the data stream or signal, separating the first Command packet from the data stream or signal to provide a remaining data stream or signal, controlling a first LED in accordance with instructions in the first command packet and outputting the remaining data stream or signal. The remaining data stream or signal is then processed in the same way with respect to the at least one subsequent Command packet.

In another aspect, the present invention provides computer executable instructions which cause a computer to perform the various steps of the methods described herein. In particular, the computer executable instructions cause the computer (such as microprocessor 10) to execute the steps of generating a first Command packet containing at least one instruction for controlling a first of the plurality of LEDs, and generating at least one subsequent Command packet containing instructions for controlling at least one subsequent LED, connected in series with the first LED. In another form, the computer executable instructions cause the computer to also generate a START code and insert this in a data stream in front of the Command and subsequent Command packets. In another form, the computer executable instructions cause the computer to generate separate START codes prior to each of the Command and subsequent Command packets.

In another aspect, the computer executable instructions also cause a computer to perform the steps performed by the driver 20. As described with reference to FIG. 8, the computer could also be a microprocessor. In this aspect, the computer executable instructions cause the computer to execute the steps of receiving a data stream including a first Command packet and at least one subsequent Command packet, separating the first Command packet from the data stream, controlling an LED associated with the computer in accordance with instructions in the first Command packet, and outputting the at least one subsequent Command packet for use by another driver.

In one form, the computer executable instructions may also cause the computer to detect a START code in the data stream, and either pass that START code through and output it with the at least one subsequent Command packet or generate a new START code and output that with the at least one Command packet.

In another aspect of the invention, there is also provided a machine readable medium containing the machine executable instructions described above. Such a machine readable medium includes the memory on the microprocessor 10, or other, separate memory medium, including a CD, a DVD, a Flash drive or other portable memory medium.

In one embodiment, the LED driver circuit could be implemented as an integrated circuit, using a suitable semiconductor technology such as but not limited to silicon. A variation of this embodiment would be to attach and integrate the circuit with an LED device. In one example, this could be an LED with 3 primary colour LED elements. In such an embodiment the current limit resistors may be integrated, or replaced by a transistor based current limiting arrangement, both techniques being well established.

In such an embodiment, which made use of a single control signal from a microprocessor, the completed packaged integrated driver circuit and LEDs would have four electrical connections comprising a power input, a power return (or ground), a data in signal, and a data out signal. An embodiment making use of two outputs from microprocessor would include a fifth electrical connection used to indicate the start of a new stream of Commands.

In one form the microprocessor 10 would transmit the Command stream at a rate of at least 100,000 bits/second. Such a rate would allow the colour and brightness of 10 RBG LEDs to be completely updated in less than 3 milliseconds. Naturally, operation at even faster speeds would be straightforward and yield commensurately lower update times. Naturally, where rapid update or only a small number of LEDs is to be controlled, a lower rate would also be suitable This arrangement has the advantages that it allows any number of combination LEDs to be driven without need for special expansion devices when an addressing range is exceeded; it allows a small number of drive signals from the controlling device; and it offers the benefit of integrating such a LED driver circuit into the same component package as the combination LED. Integration of the driver circuit into the LED package minimises the overall cost, and dramatically reduces the number of electrical interconnections between the driver IC and the colour elements of the combination LED.

The various aspects of the present invention may be used in any number of electronic devices that have LEDs as part of their circuitry. This includes entertainment devices such as televisions, digital set-top boxes, sound systems, DVD players, CD players, remote control units. It also includes computers and computer peripherals, and displays for vehicles and other devices. The various aspects of the present invention can also be applied to electronic devices that have not yet been invented at the time of filing the present application.

It will be understood that the above has been described with reference to particular embodiments and that many variations and modifications may be made within the scopes of the different aspects of the present invention.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

The invention claimed is:

1. A communications protocol for use in controlling a plurality of Light Emitting Diodes (LEDs) associated with respective LED drivers, the communications protocol comprising:

a first Command packet containing at least one instruction for controlling a first of the plurality of LEDs, and at least one subsequent Command packet containing instructions for controlling at least one subsequent LED, connected in series with the first LED; and a START code provided prior to the first Command packet, the START code for communication to each of the LED drivers to indicate the respective subsequent Command packet.

2. The communications protocol as claimed in claim 1, wherein at least one of the first and subsequent Command packets contains instructions for controlling a plurality of elements within a respective LED.

3. A Light Emitting Diode (LED) driver, comprising:

an input for receiving a signal according to the communications protocol as claimed in claim 2;

means for controlling an associated LED in accordance with the at least one instruction in the first Command packet; and an output for outputting the at least one subsequent Command packet.

4. A Light Emitting Diode (LED) driver, comprising:

an input for receiving a signal according to the communications protocol as claimed in claim 1;

means for controlling an associated LED in accordance with the at least one instruction in the first Command packet; and an output for outputting the at least one subsequent Command packet.

5. The Light Emitting Diode (LED) driver as claimed in claim 4, further comprising:

means for separating the first Command packet from the signal.

6. The Light Emitting Diode (LED), comprising:

the LED driver as claimed in claim 4.

7. An electronic device, comprising:

a plurality of Light Emitting Diodes (LEDs);

a plurality of LED drivers for controlling a respective one of the plurality of Light Emitting Diodes, each LED driver comprising:

an input for receiving a signal according to the communications protocol as claimed in claim 1;

means for controlling an associated LED in accordance with the at least one instruction in the first Command packet; and an output for outputting the at least one subsequent Command packet; and a microprocessor for generating and outputting a signal according to the communications protocol as claimed in claim 1 to a first of the plurality of LED drivers.

8. A device for controlling a plurality of LEDs, the device comprising:

means for generating and outputting a signal comprising a START code, a first Command packet, and at least one subsequent Command packet;

first means for receiving the signal and controlling an LED associated with the first means in accordance with instructions in the first Command packet;

first means for separating the first Command packet from the signal to provide a remaining signal including the START code; and means for outputting the remaining signal, wherein the START code is provided prior to the first Command packet, and wherein the START code is included in the remaining signal to indicate a subsequent Command packet.

9. The device as claimed in claim 8, wherein the means for generating is a microprocessor.

10. The device as claimed in claim 9, wherein the first means for receiving and controlling, the first means for separating and the means for outputting comprise an LED driver.

11. The device as claimed in claim 10, wherein the LED driver is a microprocessor.

12. The device as claimed in claim 10, further comprising:

at least one subsequent driver associated with at least one subsequent LED.

13. A method for controlling a plurality of LEDs, the method comprising:

generating and outputting a signal comprising a START code, a first Command packet and at least one subsequent Command packet;

receiving the signal and controlling an LED in accordance with instructions in the first Command packet;

separating the first Command packet from the signal to provide a remaining signal including the START code; and outputting the remaining signal, wherein the START code is provided prior to the first Command packet, and wherein the START code is included in the remaining signal to indicate a subsequent Command packet.

14. A non-transitory machine readable medium containing machine executable instructions to perform the method of claim 13.

* * * * *